United States Patent [19]

Green et al.

[11] Patent Number: 4,522,240

[45] Date of Patent: Jun. 11, 1985

[54] SPLITTING WEDGE FOR LOG SPLITTER

[76] Inventors: Robert H. Green, 17518 Euler Rd., Bowling Green, Ohio 43402; James D. Simon, 10410 S. Dixie Hwy., Portage, Ohio 43451

[21] Appl. No.: 578,003

[22] Filed: Feb. 8, 1984

[51] Int. Cl.[3] ..... B27L 7/00

[52] U.S. Cl. ..... 144/193 E; 144/366; 254/104; 30/308.1

[58] Field of Search ..... 254/104; 145/1 R, 2 R; 144/193 A, 193 C, 193 D, 193 E, 193 F, 3 K, 366

[56] References Cited

U.S. PATENT DOCUMENTS

| | | | |
|---|---|---|---|
| 443,581 | 12/1890 | Marshall | 144/193 E |
| 807,879 | 12/1905 | Sullivan | 145/2 R |
| 3,865,163 | 2/1975 | Root | 254/104 |
| 4,266,585 | 5/1981 | Denzer | 144/193 A |

*Primary Examiner*—W. D. Bray

*Attorney, Agent, or Firm*—Emch, Schaffer & Schaub

[57] ABSTRACT

The invention is directed to a wedge for splitting wood. The wedge has a thin cutting member which has a first end and a second end. The fist end defines a sharp edge. The cutting member is disposed where the first end first engages the wood to be split. A wedge member is pivotally connected to the second end of the cutting member. The wedge member has a substantially triangular shape. The apex of the triangular-shaped wedge member is pivotally connected to the second end of the cutting member. The base of the triangular-shaped wedge member is spaced apart from the cutting member. The wedge member pivots as the wood is split to follow the grain of the wood to reduce the splitting force required to split the wood.

13 Claims, 7 Drawing Figures

SPLITTING WEDGE FOR LOG SPLITTER

BACKGROUND OF THE INVENTION

The invention relates generally to an apparatus for use in splitting wood. More particularly, the invention is directed to an improved splitting device which has a pivotally mounted wedge-shape portion for use in splitting logs.

Prior art log splitters typically include a cutting edge which is held in a fixed position. Wood to be split is positioned adjacent the cutting edge such that the longitudinal axis of the wood is substantially parallel to the cutting edge. The log splitter also includes a means for advancing the wood towards the cutting edge which is positioned at the other end of the wood. Typically, the advancing means is a hydraulic cylinder having a piston and rod that can be advanced in a direction towards the wood to force the wood against the cutting edge. As the wood engages the cutting edge, a cut is made in the wood. The advancing means continues to force the wood against the cutting edge causing the wood to be split. In order to advance the wood against the cutting edge, much force must be applied. Often the grain of the wood to be cut does not follow the longitudinal axis of the wood and greater force is required to cut and split such wood.

The problems associated with splitting the wood become more significant if the wood is a hardwood or if the grain of the wood is small. The advancing of the hardwood against the cutting edge causes a bending or torsional force on the cutting edge.

In addition, the prior art log splitters often do not maintain the wood to be split at a proper position against the cutting edge during the splitting operation. Frequently, as the wood to be split is forced against the cutting edge the wood is forced in an upward direction, causing the wood to be only partially split. Further, since the prior art log splitters require a great deal of force to split a log, the advancing means capable of delivering the necessary force is required to adequately split the wood. Often, these advancing means are expensive to manufacture and to operate and significantly increase the price of the log splitter.

Accordingly, there is a need in the art for a wood splitter that can more easily split wood having a grain pattern that increases the difficulty of splitting the wood. Further, it is desirable to have a wood splitter that maintains the wood in the desired orientation during the splitting operation.

SUMMARY OF THE INVENTION

According to the present invention there is provided a wedge for splitting wood. The wedge is positioned on a log splitter. The wedge includes a thin cutting member which has a first sharp edge. The cutting member is disposed such that the first end of the cutting member defines the sharp edge. The sharp edge is designed to initiate a cut in the wood that is to be split. The cutting member has a second end which has a hollow cylindrical member that extends away from the second end. The opening defined by the hollow cylindrical member is disposed such that the longitudinal axis of the opening is substantially parallel to the second end. A triangular wedge member is positioned adjacent the cutting member. The triangular-shaped wedge member has a apex, a base and two side panels that extend between the apex and the base of the triangular-shaped wedge member.

The apex of the wedge member is positioned adjacent the second end of the cutting member. The wedge member pivots around an axis passing through the apex. In operation, a piece of wood to be split is positioned on the base of the wood splitter. A means for advancing the wood towards the cutting member is provided on the wood splitter. As the wood engages the first end of the cutting member the sharp edge initiates a cut in the wood. As the wood is continuously advanced, the sharp edge continues to cut through the wood. The first end of the cutting member is disposed at an acute angle with respect to the base of the wood splitter. This angle causes the wood to be forced downwardly towards the base of the wood splitter. As the wood is continuously advanced, it moves along the cutting member and comes into contact with the wedge member. The apex of the wedge member is substantially the same thickness as the thickness of the cutting member. As the wood is advanced, the triangular shape of the wedge member acts upon the wood and causes the cut initiated by the first end of the cutting member to open up and cause the wood to begin to split. To accomodate the grain of the wood that is being split, the wedge member is pivotally connected to the cutting member. Thus as the wood is advanced, the wedge member can pivot with respect to the cutting member to follow the grain of the wood.

An object of this invention is to provide an improved wedge for splitting wood.

Another object of the invention is to provide a low cost and easily operated wood splitting device.

Other objects and advantages of the invention will become apparent as the invention is described hereinafter in more detail with reference to the accompanying drawings.

DESCRIPTION OF THE PREFERRED EMBODIMENT

Figure 1:
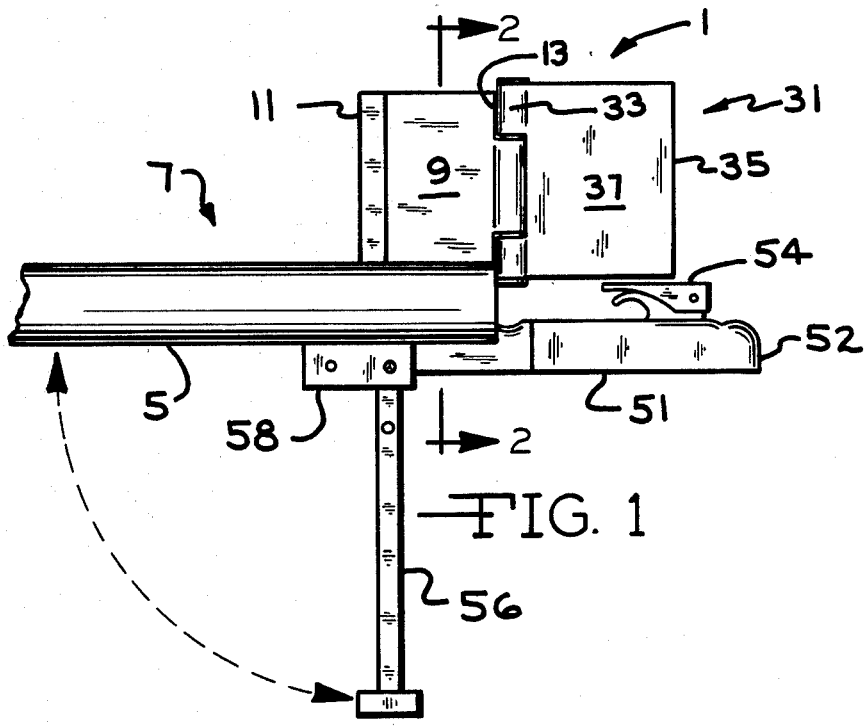
FIG. 1 is a side elevational view showing the wood splitter of the present invention.
Figure 2:
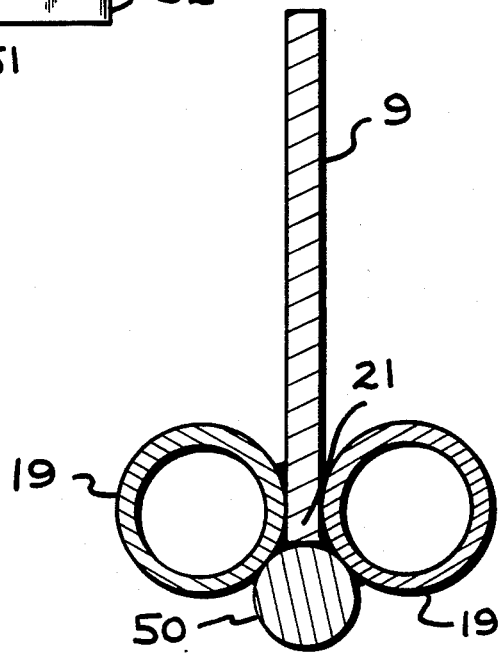
FIG. 2 is a cross-sectional view of the splitting device taken along line 2—2 in FIG. 1.
Figure 3:
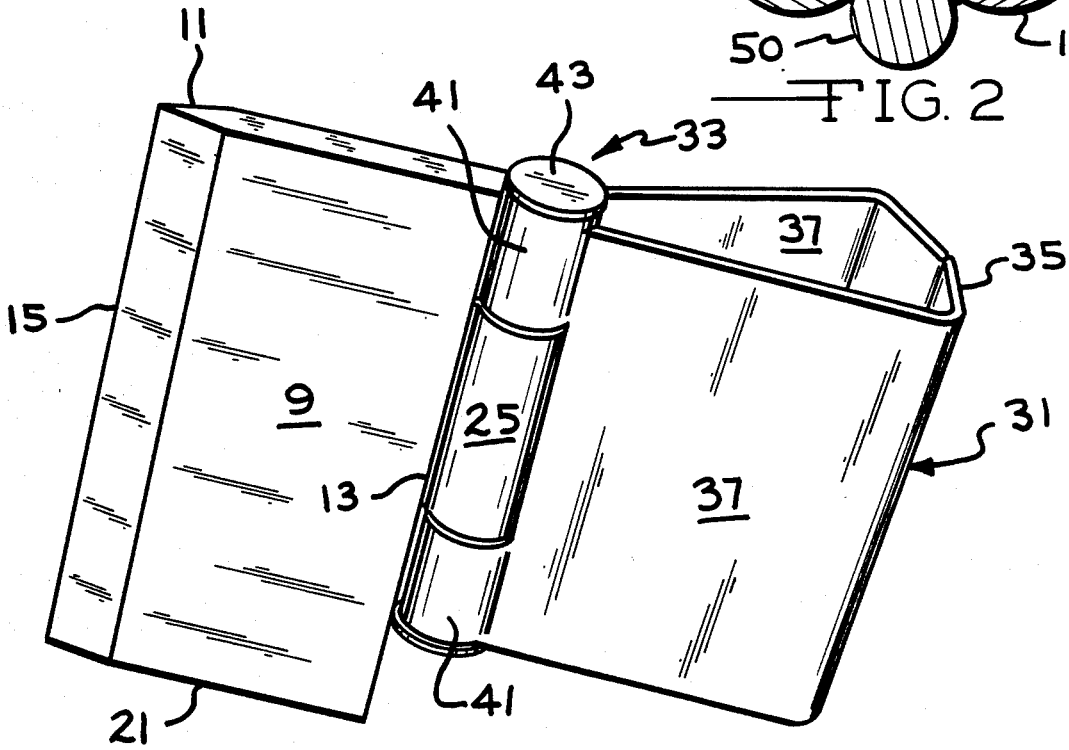
FIG. 3 is a perspective view of the splitting device.

This invention is directed to a splitting device that is used in conjunction with a wood splitter. More particularly, the splitting device has a pivoting wedge designed to reduce the splitting force required to split a particular piece of wood. The details of the invention will be more readily understood by referring to the attached drawings in connection with the following description.

The splitting device 1 is usually connected to the base 5 of a wood splitter 7. The splitting device 1 has a thin cutting member 9 having a first end 11 and a second end 13. The first end of the splitting device defines a sharp edge 15. The sharp edge 15 is disposed so that the sharp edge first engages the wood that is to be split by the splitting device. The sharp edge 15 and the thin cutting member 9 are designed to initiate a cut in the wood that is to be split. This cut is later spread apart to split the wood.

In the embodiment shown the base 5 of the wood splitter 7 is comprised of two substantially parallel tubes 19 that are in adjacent spaced apart relationship. The two tubes 19 form the base 5 upon which the wood to be split can be positioned. The groove formed between the two tubes 19 acts to maintain the wood on the base 5 of the wood splitter 7 and to center the wood splitter 7 with respect to the cutting member 9. The lower section 21 of the cutting member 9 is positioned adjacent the two spaced apart tubes 19. The lower section 21 is secured to the tubes 19 by welding or other suitable securement means to firmly secure the cutting member 9 to the tubes 19. The cutting member 9 is positioned between the two tubes 19 so that the second end 13 of the cutting member 9 is in substantial alignment with the end of the tubes 19. In practice it has been found particularly desirable to secure the cutting member 9 to the tubes 19 at a point that is substantially along the neutral axis to the tubes 19.

The second end 13 of the cutting member 9 has a hollow cylindrical member 25 that extends away from the second end 13. The opening defined by the hollow cylindrical member 25 is disposed so that the longitudinal axis of the opening is substantially parallel to the second end 13.

A triangular-shaped wedge member 31 is positioned adjacent the cutting member 9. The triangular-shaped wedge member 31 has a apex 33, a base 35 and two side panels 37 that extend between the apex 31 and the base 35 of the triangular-shaped wedge member 31. The apex 33 of the wedge member 31 is positioned adjacent the second end 13 of the cutting member 9. The base 35 of the wedge member 31 is spaced apart from the second end 13 of the cutting member 9. The base 35 of the wedge member 31 is at least twice as wide as the thickness of the cutting member 9. In practice it has been found that the base 35 of the wedge member 31 should be from about 2 to about 5 times as wide as the thickness of the cutting member 9. The apex 33 of the triangular-shaped wedge member 31 defines two hollow cylindrical chambers 41 on each end of the apex 33. The opening defined by the hollow cylindrical chambers 41 are in alignment with the hollow opening in the cylindrical member 25 that is connected to the second end 13 of the cutting member 9. A pin 43 is positioned in the hollow openings of the cylindrical member 25 and the cylindrical chambers 41 to pivotly secure the wedge member 31 to the cutting member 9. In this manner the wedge member 31 can pivot around an axis passing through the wedge member 31. The wedge member 31 constructed so that it it positioned in the location beyond the end of the base 5 of the wood splitter 7. This prevents any interference with the pivotal movement of the wedge member 31.

In operation a piece of wood to be split is positioned on the base 5 of the wood splitter. The piece of wood is supported on the two tubes 19 which form the base 5. The V-shaped groove defined between the two spaced apart tubes 19 will act to center the wood on the base 5 and to hold the wood in position on the base during the splitting operation. A means for advancing the wood toward the cutting member 9 is provided on the wood splitter 7. This means is usually a hydraulic cylinder having a piston and rod that can be advanced in a direction to force the wood to be split against the cutting member 9. As the wood engages the first end 11 of the cutting member 9, the sharp edge 15 will initiate a cut in the wood. As the wood is continuously advanced the sharp edge 15 will continue to make a cut through the wood. The first end 11 of the cutting member 9 is disposed at an acute angle with respect to the base 5 of the wood splitter. As the wood is advanced against the first end 11, this angle will cause the wood to be forced downwardly towards the base 5 of the wood splitter. In this manner the wood is maintained in the proper position on the base 5 during the splitting operation.

As the wood is continuously advanced it moves along the cutting member 9 and comes into contact with the wedge member 31. The apex 33 of the wedge member 31 is substantially the same thickness as the thickness of the cutting member 9. As the wood is advanced the triangular-shape of the wedge member 31 will act upon the wood and will cause the cut initiated by the first end 11 of the cutting member 9 to open up and cause the wood to begin to split. As the wood passes along the wedge member 31, the cut in the wood will be progressively opened due to the wedge shape configuration of the wedge member 31.

Frequently, the wood to be split will have a grain or configuration where the wood does not split in a straight manner. This is particularly true where logs are being split by the wood splitter 7. To accomodate the grain of the wood that is being split the wedge member 31 is pivotally connected to the cutting member 9. Thus, as the wood is advanced the wedge member 31 can pivot with respect to the cutting member 9 to follow the grain of the wood. This is particularly important since the wedge member 31 follows the grain of the wood making it easier for the wedge member 31 to open up the cut in the wood and complete the splitting of the wood. The pivoting of the wedge member 31 also maintains the force on the log in a direction that is straight into the first edge 11 of the cutting member 9. This significantly reduces the cutting force and splitting force required to split a piece of wood.

In the embodiment shown, the splitting device 1 is positioned on a support structure 50. The support structure 50 has a trailer hitch 51 extending therefrom with a receptacle 52 positioned at one end of the support structure 50 to operatively receive a ball hitch (not shown). A latch mechanism 54 is operatively positioned adjacent the receptacle 52 such that the wood splitter 7 can be attached to a vehicle for towing. A stand or brace 56 is positioned at the end of the support structure 50 opposite the ball hitch receptacle 52. The stand 56 is positioned on the side of the support structure 50 that is opposite the splitting device 1. The stand 56 is pivotally mounted on the support structure 50 by means of a bracket and pin assembly 58. When the wood splitter 7 is in use the stand 56 is pivoted in a direction away from the wood splitter 7. The stand 56 acts to maintain the wood splitter 7 in a stable position when the wood splitter 7 is in use. The stand 56 can be pivoted in a direction towards the wood splitter 7 when the wood splitter 7 is not in use.

Figure 4:
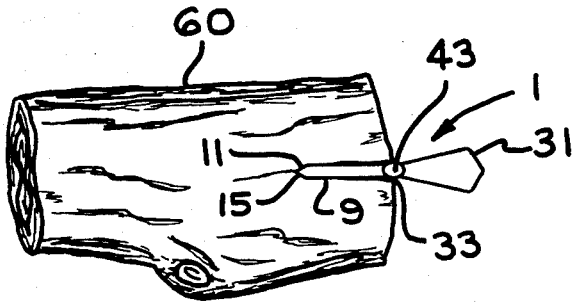
FIG. 4 is a schematic view showing the operation of the splitting device.
Figure 5:
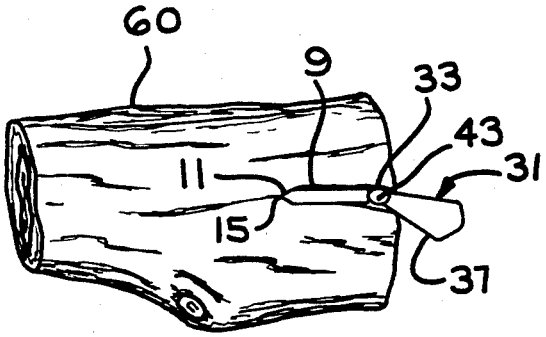
FIG. 5 is a schematic view showing the operation of the splitting device.
Figure 6:
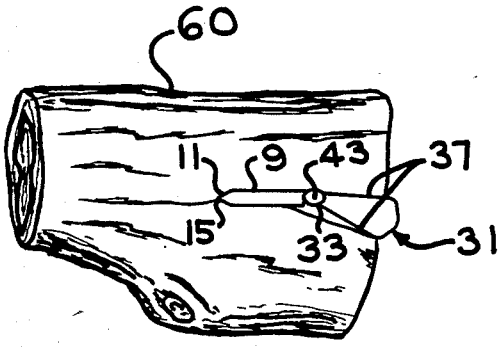
FIG. 6 is a schematic view showing the operation of the splitting device.
Figure 7:
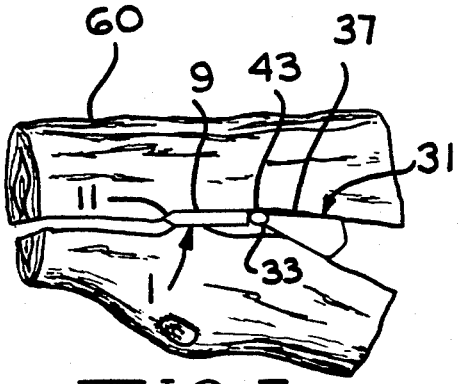
FIG. 7 is a schematic view showing the operation of the splitting device.

Referring now to FIGS. 4—7, the splitting device 1 is shown positioned in the wood 60 to be split. FIG. 4 shows the sharp edge 15 and the first end 11 of the cutting member 9 in an initial cutting position in the wood 60. FIG. 5 shows the wood 60 advanced against the splitting device 1 such that the apex 33 of the wedge member 31 is within the cut formed by the cutting member 9. FIG. 6 shows the wood 60 further advanced against the splitting device 1 such that the side panels 37 of the wedge member 31 engage the sides of the cut in the wood 60. The wedge-shaped configuration of the wedge member 31 acts to progressively open the cut in the wood 60. The wedge member 31 is pivoted about the axis through the pin 43 with respect to the cutting member 9 to follow the grain of the wood 60. FIG. 7 shows the wood 60 split apart by the splitting device.

The above description is given only for the sake of explanation. Various modifications and substitutions other than those cited can be made without departing from the scope of the following claims.

What we claim:

1. A wedge for splitting wood comprising;

a thin cutting member having a first end and a second end, said first end defining a sharp edge, said cutting member being disposed where said first end first engages said wood to be split;

a wedge member pivotly connected to said second end of said cutting member, said wedge member having a substantially triangular shape with the apex of said triangular-shaped wedge member being pivotly connected to said cutting member and the base of said triangular-shaped wedge member being spaced apart from said cutting member, whereby said wedge member can pivot as said wood is split to follow the grain of said wood to reduce the splitting force required to split said wood.

2. The wedge of claim 1 wherein said cutting member is connected to a wood splitter.

3. The wedge of claim 1 wherein said wedge member extends substantially along the entire length of said second end of said cutting member.

4. The wedge of claim 1 wherein said wedge member is pivotally connected to said cutting member such that said wedge member rotates about an axis that passes through said apex of said triangular-shaped wedge member.

5. The wedge of claim 1 wherein said base of said triangular-shaped wedge member is at least twice as thick as said cutting member.

6. The wedge of claim 1 wherein said base of said triangular-shaped wedge member is from about 2 about 5 times the thickness of said cutting member.

7. The wedge of claim 2 wherein said wood splitter has two substantially parallel and adjacent cylindrical tubes, said tubes forming a base for said wood that is to be split, said cutting member being connected to one end of said tubes.

8. The wedge of claim 7 wherein said cutting member of said wedge extends between said tubes, said cutting member being secured to said tubes along the neutral axis of said tubes whereby when a splitting force is applied against said cutting member said force will be transferred to said tubes in a bending and a torsional manner as said cutting member is secured to said tubes along said longitudinal axis of said tubes.

9. The wedge of claim 8 wherein said cutting member is positioned substantially perpendicular to said tubes.

10. The wedge of claim 8 wherein said first end of said cutting member is disposed at an acute angle to said tubes whereby wood forced against said first end of said cutting member is forced towards and held against said tubes of said wood splitter because of said angular position of said first end of said cutting member with respect to said tubes.

11. The wedge of claim 10 wherein said first end of said cutting member is disposed at an angle of from about 65° to about 85° with said tubes of said wood splitter.

12. The wedge of claim 1 wherein said second end of said cutting member defines a hollow cylindrical member that extends from substantially the center of said second end, said apex of said triangular-shaped wedge member defining a hollow cylindrical chamber on each end of said apex, said hollow opening of said cylindrical member being in alignment with said hollow opening in said chambers, a pin passing through said openings to pivotally connect said wedge member to said cutting member.

13. A wood splitter comprising:

two substantially parallel and adjacent tubes, said tubes defining a support base for wood that is to be split;

a thin cutting member having a first end a second end, said first end defining a sharp edge for initiating a cut in said wood to be split, said first end being disposed to first engage said wood, said cutting member extending between and being connected to said tubes, said cutting member being disposed at an angle of about 65° to about 85° with respect to said tubes, said cutting member being secured to said tubes along said neutral axis of said tubes whereby said cutting member exerts torsional forces as well as bending force on said tubes when said wood to be split is advanced against said cutting member; and, a triangular-shaped wedge member having an apex and a base, said apex of said wedge member being pivotally connected to said second end of said cutting member and said base being spaced apart from said cutting member, said base pivoting about an axis that passes through said apex of said triangular-shaped wedge member, said base being from about 2 to about 5 times the thickness of said cutting member whereby said wedge member can pivot with respect to said cutting member as said wood is split to follow the grain in said wood to reduce the splitting force required to split said wood.

* * * * *